United States Patent [19]

Kwast

[11] Patent Number: 5,023,405

[45] Date of Patent: Jun. 11, 1991

[54] ELECTRIC CABLE COMPRISING A BRAID SURROUNDING THE CABLE CORE

[75] Inventor: Ekkehard Kwast, Solingen, Fed. Rep. of Germany

[73] Assignee: U.S. Philips Corporation, New York, N.Y.

[21] Appl. No.: 487,676

[22] Filed: Mar. 1, 1990

[30] Foreign Application Priority Data

Mar. 2, 1989 [DE] Fed. Rep. of Germany ..... 3906575

[51] Int. Cl.[5] ..... H01B 7/34

[52] U.S. Cl. ..... 174/109; 174/106 R; 174/108

[58] Field of Search ..... 174/106 R, 108, 109

[56] References Cited

U.S. PATENT DOCUMENTS

| | | | |
|---|---|---|---|
| 2,488,527 | 11/1949 | Dutcher | 174/108 |
| 4,317,000 | 2/1982 | Ferer | 174/108 |
| 4,491,939 | 1/1985 | Carpenter | 174/108 X |
| 4,641,110 | 2/1987 | Smith | 174/36 |

FOREIGN PATENT DOCUMENTS

| | | | |
|---|---|---|---|
| 524649 | 4/1931 | Fed. Rep. of Germany | 174/108 |
| 3540684 | 5/1987 | Fed. Rep. of Germany . | |
| 816295 | 5/1937 | France | 174/108 |

*Primary Examiner*—Morris H. Nimmo

*Attorney, Agent, or Firm*—Brian J. Wieghaus

[57] ABSTRACT

The invention relates to an electric cable comprising a braid which consists of crossed metallic braiding elements and surrounds the cable core, in which braided non-metallic elements of a high tensile strength are braided. Improved values for resistance to interference radiation and damping are obtained in that the metallic braiding elements and the non-metallic elements are arranged radially one over the other in parallel.

18 Claims, 2 Drawing Sheets

ELECTRIC CABLE COMPRISING A BRAID SURROUNDING THE CABLE CORE

BACKGROUND OF THE INVENTION

The invention relates to an electric cable comprising a braid which consists of crossed metallic braiding elements and which surrounds the cable core, in which braided non-metallic elements of a high tensile strength have been braided.

In the cable of this type, known from DE-A 35 40 684, non-metallic threads of a high tensile strength have been united with metallic wires of a high electric conductivity to form a mixed braid. The electrically conductive wires which consist of soft copper or aluminium, cannot stand high tensile forces. The non-metallic threads which consist, for example, of aromatic polyamide fibers such as Kevlar are added to the braid to withstand high tensile stress in the cable. As a result of the non-metallic threads which in the braid replace so to say a metal thread, metal-free open areas occur towards the interior of the cable. As a result of this, higher dampings occur in such a high-frequency cable, the resistance to interference radiation decreases.

SUMMARY OF THE INVENTION

It is the object of the invention to improve the resistance to interference radiation of a cable of the type mentioned in the opening paragraph and to avoid increases in damping.

According to the invention this object is achieved in that the metallic braiding elements and the non-metallic elements are arranged radially one over the other in parallel.

With the arrangement of the non-metallic elements according to the invention the mixed braid remains electrically as dense as in a purely metallic braid.

At the areas where a non-metallic element is clamped between the folds of the braid, i.e. under the crossing braiding element, it produces a frictional cohesion of the crossing braiding elements. As a result of this tensile loadability of the cable is additionally increased. The cross-section required for the non-metallic pull-relief elements is so small that the diameter of the cable is not noteworthily increased by it, whereas the tensile strength is multiplied. The mechanical properties of the cable, for example, flexibility and temperature resistance, are not deteriorated.

The electric properties in particular of a high-frequency cable then are not influenced by the non-metallic elements when these are arranged radially over the metallic braiding elements. Only metallic braiding elements then engage the dielectric layer.

The metallic braiding elements preferably consist of parallel-extending individual wires. The non-metallic elements then advantageously extend in the form of a tape over at least a part of the individual wires. Due to the particularly small radial dimensions of the non-metallic elements, increase in the diameter of the cable does substantially not occur.

An improved bonding between the crossings of the braiding elements and also to an optionally extruded synthetic resin envelope is achieved by glueing. In particular, the non-metallic elements may be coated with a hot melt glue, of adhesive, which upon heating produces a bonding to adjacent cable construction elements.

A particularly high tensile strength is obtained when the braid is provided so as to tightly engage an internal pressure-resistant cable construction element. A suitable pressure-resistant cable construction element is in particular the dielectric insulating layer of a coaxial cable.

BRIEF DESCRIPTION OF THE DRAWINGS

The invention will now be described in greater detail with reference to the drawing.

DESCRIPTION OF THE PREFERRED EMBODIMENT

Figure 1:
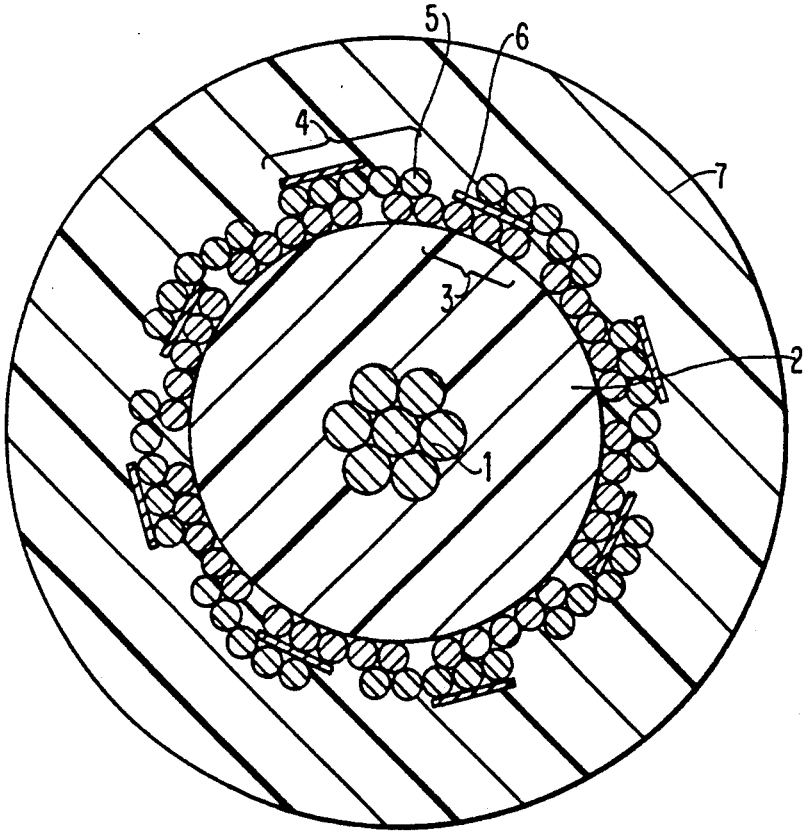
FIG. 1 is a cross-sectional view through a high-frequency coaxial cable constructed according to the invention.
Figure 2:
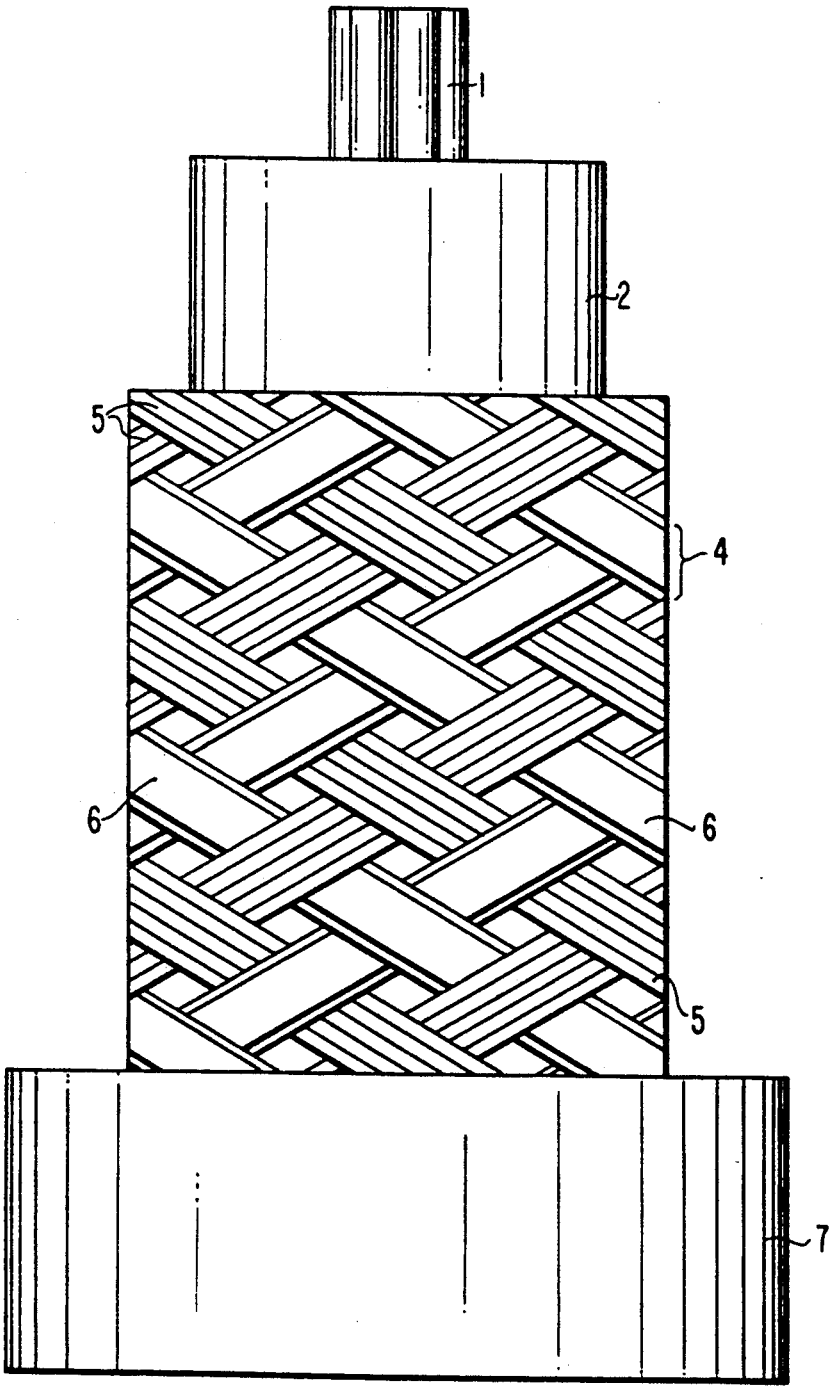
FIG. 2 is a pictorial view of the crossed cable braid illustrating the radial braiding of the non-metallic elements with the metallic elements.

A preferred use for such cables according to the invention are self-supporting reels for the electric connection to moving guiding members. Such cables are seawater-resistant down to depths of 200 m.

A braid is tightly braided around a central stranded conductor 1 and an insulating dielectric 2. It consists of oppositely coiled braiding elements 3 and 4, respectively, which alternately extend on the inside and outside by folding. They each consist, for example, of five soft copper wires 5.

A non-metallic element 6 which consists of numerous Kevlar threads is associated with every other braiding element 3 and 4, respectively, and engages the braiding elements 3 and 4, respectively, in the form of a flat tape.

By coating the non-metallic elements 6 with a hot melt glue or adhesive a bonding between the braiding elements and also a bonding to the cable envelope 7 can be achieved after heating at the overlap areas.

Preferably, the non-metallic elements, upon entering a braiding apparatus, are provided against the metallic braiding elements. Outer conductors and pull-relief are then produced in one common process step.

The tensile strength of the cable described is threefold higher than in a cable having a non-reinforced copper braiding. By providing eight additional non-metallic elements 6 a 6-fold tensile strength could be reached.

Expansions of only approximately 2.5% were found up to the tearing limit, so that the cable remains in operation until destruction.

I claim:

1. An electric cable having a cable core, and a braid surrounding the cable core, said braid comprising crossed metallic braiding elements and high tensile strength non-metallic braiding elements, the improvement, comprising:

said non-metallic braiding elements being arranged radially with respect to and in parallel with corresponding metallic braiding elements.

2. A cable as claimed in claim 1, further comprising an internal pressure-resistant cable element, and said braid engages tightly around said pressure-resistant cable element.

3. A cable as claimed in claim 1, characterized in that the non-metallic elements consist of aromatic polyamide fibers.

4. A cable as claimed in claim 3, further comprising an internal pressure-resistant cable element, and said braid engages tightly around said pressure-resistant cable element.

5. A cable as claimed in claim 1, characterized in that a metallic said braiding element consists of parallel-extending individual wires and that a said non-metallic element is a flat tape extending over at least a part of the individual wires.

6. A cable as claimed in claim 1, characterized in that a hot melt glue bonds the non-metallic elements to adjacent metallic elements of the cable.

7. A cable as claimed in claim 1, characterized in that the non metallic elements are provided radially over the metallic braiding elements.

8. A cable as claimed in claim 7, further comprising an internal pressure-resistant cable element, and said braid engages tightly around said pressure-resistant cable element.

9. A cable as claimed in claim 7, characterised in that the non-metallic elements consist of aromatic polyamide fibers.

10. A cable as claimed in claim 7, characterized in that a hot melt glue bonds the non-metallic elements to adjacent metallic elements of the cable.

11. A cable as claimed in claim 7, characterised in that a said metallic braiding element consists of parallel-extending individual wires and that a said non-metallic element is a flat tape extending over at least a part of the individual wires.

12. A cable as claimed in claim 11, further comprising an internal pressure-resistant cable element, and said braid engages tightly around said pressure-resistant cable element.

13. A cable as claimed in claim 11, characterised in that the non-metallic elements consist of aromatic polyamide fibers.

14. A cable as claimed in claim 15, further comprising an internal pressure-resistant cable element, and said braid engages tightly around said pressure-resistant cable element.

15. A cable as claimed in claim 11, characterized in that a hot melt glue bonds the non-metallic elements to adjacent metallic elements of the cable.

16. A cable as claimed in claim 15, characterised in that said non-metallic elements consist of aromatic polyamide fibers.

17. A cable as claimed in claim 16 further comprising an internal pressure-resistant cable element, and said braid engages tightly around said pressure-resistant cable element.

18. A cable as claimed in claim 17, characterised in that said pressure-resistant cable element is the dielectric insulating layer of a coaxial cable.

* * * * *